US007288351B2

(12) United States Patent
Yaguchi et al.

(10) Patent No.: US 7,288,351 B2
(45) Date of Patent: Oct. 30, 2007

(54) MAGENTA TONER FOR DEVELOPING ELECTROSTATIC IMAGES, PROCESS FOR PRODUCTION THEREOF, DEVELOPER AND IMAGE-FORMING METHOD

(75) Inventors: Hidekazu Yaguchi, Minamiashigara (JP); Yasuo Matsumura, Minamiashigara (JP); Kazuhiko Yanagida, Minamiashigara (JP); Manabu Serizawa, Minamiashigara (JP); Tsutomu Kubo, Minamiashigara (JP); Shigeru Seitoku, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 173 days.

(21) Appl. No.: 10/793,736

(22) Filed: Mar. 8, 2004

(65) Prior Publication Data

US 2005/0008960 A1 Jan. 13, 2005

(30) Foreign Application Priority Data

Jul. 10, 2003 (JP) ..... 2003-194796

(51) Int. Cl.
*G03G 9/09* (2006.01)

(52) U.S. Cl. ..... 430/108.1; 430/108.21; 430/125; 430/137.14

(58) Field of Classification Search ..... 430/108.1, 430/108.21, 108.23, 125, 137.14
See application file for complete search history.

(56) References Cited

U.S. PATENT DOCUMENTS 5,204,207 A * 4/1993 Yamashita et al. ..... 430/114
6,664,016 B2 * 12/2003 Kanbayashi et al. ... 430/108.23

FOREIGN PATENT DOCUMENTS

| | | |
|---|---|---|
| JP | A 63-282752 | 11/1988 |
| JP | A 6-250439 | 9/1994 |
| JP | A 2002-156795 | 5/2002 |

OTHER PUBLICATIONS

English translation of JPO 2002-156795.*

* cited by examiner

*Primary Examiner*—John L Goodrow
(74) *Attorney, Agent, or Firm*—Oliff & Berridge, PLC

(57) ABSTRACT

A magenta toner for developing electrostatic images provided which contains a binder resin and a colorant, wherein the colorant includes a mixed crystal of two or more colorants and when a solid patch is fixed on art paper complying with the ISO standard by using this toner, a resulting fixed image color satisfies at least one of the following formulae (b*)<0.85 (a*)−67.92; and (b*)>−7.94 (a*)+591.85. The color difference ΔE between the color of the fixed image and the color characterized by L*: 46.6, a*: 75.1 and b*: −4.4 is preferably less than 6. The colorant is preferably a mixed crystal of a quinacridone colorant and a monoazo colorant. Moreover, the invention provides a method for producing the magenta toner, a developer containing the magenta toner, and an image-forming method using the magenta toner.

14 Claims, No Drawings

MAGENTA TONER FOR DEVELOPING ELECTROSTATIC IMAGES, PROCESS FOR PRODUCTION THEREOF, DEVELOPER AND IMAGE-FORMING METHOD

CROSS-REFERENCE TO RELATED APPLICATION

This application claims benefit of and priority to Japanese Patent Application No. 2003-194796 filed on Jul. 10, 2003, which is incorporated herein by reference in its entirety for all purposes.

BACKGROUND OF THE INVENTION

1. Field of the Invention

The present invention relates: to a dispersion of a colorant being suitably used in the production of a magenta toner for developing electrostatic images wherein the toner is superior, for example, in light transmitting property and coloring ability and has a wide color gamut and can be employed suitably in image formation by electrophotography; to a toner for developing electrostatic images obtained using the dispersion; to a method for efficiently producing the toner for developing electrostatic images; and to an electrostatic image developer and image-forming method using the toner for developing electrostatic images.

2. Description of the Related Art

Methods for making image information visible via electrostatic images, such as electrophotography, are widely used in various fields. In electrophotography, an electrostatic image is formed on a photosensitive body via a charging step, an exposure step and the like. The electrostatic image is developed by use of a developer containing toner particles. Thus, the electrostatic image is made visible via a transfer step and a fixation step.

As the developer to be used here, two-component developers, which include toner particles and carrier particles, and mono-component developers, which include magnetic toner particles or nonmagnetic toner particles, are known.

The toner particles in these developers are generally produced by a kneading-pulverizing process. The kneading-pulverizing process is a method in which desired toner particles are produced by melt-kneading a thermoplastic resin and the like with a pigment, a charge-controlling agent, a releasing agent such as wax and the like, finely pulverizing the melt-kneaded material after cooling, and classifying the pulverized matter. In addition, inorganic and/or organic fine particles may, if necessary, be added to the surface of the toner particles produced by the kneading-pulverizing process for the purpose of improving fluidity, cleanability and the like.

Generally the toner particles produced by the kneading-pulverizing process are irregularly shaped and are not uniform in surface composition. Depending on the pulverizability of the material to be used and on the conditions of the pulverization step, the shape and surface composition of toner particles change slightly. However, it is difficult to control these factors intentionally at desired degrees. In particular, in the case of toner particles produced by the kneading-pulverizing process using a highly pulverizable material, the toner particles are often further micronized or their shape changed inside a developing device due to mechanical forces such as various types of shearing force. As a result, the following problems have arisen. Regarding two-component developers, micronized toner particles may stick on the surface of a carrier and accelerate the electrostatic degradation of the developer. On the other hand, regarding mono-component developers, their particle size distribution is enlarged, thus fine toner particles might be scatter and a reduction in developability with a change of the toners shape might cause deterioration of image quality.

Irregularly shaped toner particles cannot demonstrate a sufficient fluidity even if a fluidity aid is added thereto. Moreover, fine particles of the fluidity aid are conveyed to recessed portions of the toner particles by the mechanical forces, such as shearing force, applied during the use of the toner and the fine particles become buried in the recessed portions. Thus, problems, such as reduction in fluidity with time and deteriorations of developability, transferability and cleanability arise. In addition, when such a toner is reused after being recovered through a cleaning treatment and fed back to a developing device, deterioration of image quality easily occurs. Increasing the amount of the fluidity aid is a possible way to prevent these problems. This, however, might cause another problem of generation of black points on a photosensitive body and a problem of scattering particles of the fluidity aid.

On the other hand, in the case of toners containing a releasing agent, such as wax, which has been internally added, the releasing agent may be exposed in the surface of toner particles when it is used in combination with some thermoplastic resin. Particularly in the case of toners including a combination of a resin which has been imparted with elasticity by a high molecular weight component and which is slightly resistant to pulverization and a fragile wax such as polyethylene, much exposure of polyethylene can be seen in the surface of the toner particles. Such toners are advantageous from the viewpoints of mold releasability at the time of fixation and ease of cleaning untransferred toner. However, the polyethylene on the surface of the toner particles are easily detached from the toner particles by action of mechanical force, such as shearing force, applied in a developing device and migrate to a developing roll, a photosensitive body, a carrier and the like. Thus, these elements are easily contaminated to cause reduction in reliability as a developer. Under such circumstances, an emulsion-polymerization flocculation process has been proposed in Japanese Patent Application Laid-Open (JP-A) Nos. 63-282752 and 6-250439 as means for producing a toner including particles whose shape and surface composition are intentionally controlled. The emulsion-polymerization flocculation process is a process as follows. A resin dispersion is prepared by emulsion polymerization. Separately, a colorant dispersion in which a colorant is dispersed in solvent is prepared. These are mixed to form aggregated particles with a size corresponding to the toner particle diameter. Then the aggregated particles are heated and fused together. Thus toner particles are obtained. When the emulsion-polymerization flocculation process is used, the shape of toner can be controlled optionally from an irregular form through a spherical form through a choice of the heating temperature. However, in the emulsion-polymerization flocculation process, because aggregated particles in a uniformly mixed state are fused together, the composition from the inside of the toner to the surface thereof becomes uniform. Therefore, it is difficult to intentionally control the structure and composition of the surface of toner particles. In particular, when the aggregated particles contain a releasing agent, the releasing agent is present in the surface of the toner particles after being fused. Therefore, filming may occur or external additives used for imparting fluidity might become buried in the inside of the toner. In the electrophotographic process, for keeping and demonstrating the performance of a toner with stability under various types of mechanical stress, it is necessary to inhibit a releasing agent from being exposed in the surface of toner particles, enhance the surface hardness of the toner particles, and increase the smoothness of the surface of the toner particles. The releasing agent may cause various problems if it is exposed in the surface of toner particles. However, taking the performance of the toner at the time of its fixation into consideration, it is preferable that the releasing agent be present near the surface of the toner particles.

With a recent increase of demand for improvement in image quality, there is a remarkable tendency to reduce the size of toner in order to realize highly precise images particularly in color image formation. However, only reducing the size of toner while making the toner have a particle size distribution the same as that of conventional toners have will cause serious problems of contamination of carriers and photosensitive bodies and scatter of toners because of the presence of toners in the fine particle size region in the particle size distribution. It therefore is difficult to realize a high image quality and a high reliability simultaneously. In order to realize a high image quality and a high reliability simultaneously, it becomes necessary to sharpen the particle size distribution of toners and also to reduce the size of toners.

In addition, for the purposes of improvement in color reproduction and expansion of color gamut of color toner images, various kinds of pigments and dyes have heretofore been examined as colorants. However, dyes are inferior to pigments in water resistance and light fastness and may cause problems of color migration and the like when the dyes come into contact with a polyvinyl chloride sheet. Accordingly, pigments are often chosen as colorants for color toners. On the other hand, pigments have drawbacks of poor brightness and poor saturation in comparison with dyes. Therefore, pigments having broader brightness and saturation are always demanded.

Although quinacridone colorants, monoazo colorants, diketopyrrolopyrrole colorants, thioindigo colorants and the like have conventionally been employed for magenta toners, quinacridone pigments have been employed widely because they are superior in sharpness and transparency.

However, toners made from quinacridone colorants are characterized by their bluish tint, which is strong relative to the hue, brightness and saturation of the magenta defined in Japan Color.

On the other hand, toners made from monoazo colorants are characterized by their yellowish tint, which is strong relative to the hue, brightness and saturation of the magenta defined in Japan Color.

The importance of color matching between images on a display, printed images and images outputted by an image-forming apparatus, is increasing with recent remarkable progress to DTP.

An approach for improving the color reproduction, gradation, light fastness and chargeability and for improving the matching with image-forming apparatuses by mixing a quinacridone colorant and a monoazo colorant while making use of their characteristics has been proposed (see JP-A No. 2002-156795).

However, mixing pigments generally causes "cloudiness", which will result in a problem that a toner made from mixed crystals will have a color gamut narrower than that calculated from the color gamuts of toners each of which is made from a single pigment.

SUMMARY OF THE INVENTION

The present invention is provided in view of the above-described problems. That is, the invention provides a magenta toner which demonstrates a color closer to the color regulation of Japan Color by use of some kinds of pigments, thereby achieving a wider color gamut.

The invention also provides a toner for developing electrostatic images, the toner being superior in properties such as developability, transferability, fixability and cleanability, by controlling the structure and composition of the region from the surface of a toner particle to the inside thereof.

The invention also provides a toner for developing electrostatic images, the toner being able to keep and demonstrate those properties with stability and thus being high reliable.

The invention also provides a method for the production of a toner for developing electrostatic images by which method the toner for developing electrostatic images superior in the above-mentioned properties can be produced easily and simply.

The invention provides a two-component electrostatic image developer which exhibits a high transfer efficiency, requires a small consumption of toner, and has a long life.

In addition, the invention provides an image-forming method by which a high-quality, highly-reliable, full color image can be formed easily and simply.

Moreover, the invention provides an electrostatic image developer and an image-forming method which can yield a high image quality in systems having no cleaning mechanism, namely, cleaner-less systems.

Furthermore, the invention provides an electrostatic image developer and an image-forming method which are highly suitable for systems reusing toners recovered from cleaners, namely, toner recycle systems and can yield a high image quality in such systems.

The present inventors studied diligently and, as a result, found that only mixing two or more colorants results in occurrence of cloudiness and that use of a mixed crystal of two or more colorants which has a color within a certain range can solve the above-mentioned problems. Thus, the present invention is accomplished. The invention provides the following.

Namely, the present invention provides a magenta toner for developing electrostatic images which comprises a binder resin and a colorant, wherein the colorant includes a mixed crystal of two or more colorants, and when a solid patch is fixed on art paper complying with the ISO standard by using the toner, a resulting fixed image color satisfies at least one of the following formulae (A) and (B):

$$(b^*)<0.85(a^*)-67.92 \quad (A)$$

$$(b^*)>-7.94(a^*)+591.85 \quad (B)$$

Further, the present invention provides a method for producing a toner for developing electrostatic images, the method comprising: preparing an aggregated particle dispersion by mixing a resin particle dispersion obtained by dispersing resin particles and a colorant dispersion obtained by dispersing a colorant in an aqueous medium, and making the resin particles and the colorant aggregate to form aggregated particles; and forming toner particles by heating and fusing the aggregated particles, wherein the toner is the above-described magenta toner of the present invention.

Further, the present invention provides an electrostatic image developer comprising a carrier and the above-described magenta toner of the present invention.

Furthermore, the present invention provides an image-forming method, comprising: forming an electrostatic latent image on an electrostatic latent image holding member; developing the electrostatic latent image with a developer layer on a developer holding member layer to form a toner image; transferring the toner image onto a transfer member; and cleaning to remove a toner for developing electrostatic images remaining on the electrostatic latent image holding member, wherein the developer is the above-described electrostatic image developer of the present invention.

DETAILED DESCRIPTION OF THE INVENTION

The presently invented magenta toner for developing electrostatic images contains a binder resin and a colorant.

The toner is characterized in that the colorant includes a mixed crystal of two or more colorants, and when a solid patch is fixed on art paper complying with the ISO standard by using the toner, a resulting fixed image color satisfies at least one of the following formulae (A) and (B):

$$(b^*)<0.85(a^*)-67.92 \quad (A)$$

$$(b^*)>-7.94(a^*)+591.85 \quad (B)$$

Moreover, in the invention, it is desirable when a solid patch is fixed on art paper complying with the ISO standard by using the toner, the color difference ΔE between the color of the fixed image and the magenta defined by JAPAN COLOR 2000, that is, the magenta color defined by L*: 46.6, a*: 75.1 and b*: −4.4, is less than 6. In this regard, ISO12647-2 defines the conditions of art paper as having whiteness in a range from 75 to 85, glossiness in a range from 73 to 77, L* in a range from 90.0 to 96.0, a* in a range from −1.5 to 2.5, and in a range from −1.6 to 2.4.

Although the colorant used in the invention is not particularly limited as long as it satisfies at least one of the formulae (A) and (B), a mixed crystal of a quinacridone colorant with a monoazo colorant is preferable because a clearer color is demonstrated when they are combined to form a mixed crystal. When colorants other than those mentioned above are used, a wide color gamut cannot be expected for some kinds of mixed crystal. Moreover, in some cases, the color gamut of a toner prepared from a mixture of pigments may be narrower than that calculated from the color gamuts of toners each of which is made from a single pigment.

Examples of the quinacridone colorant for use in the invention include pigment compositions represented by following formula (1).

Formula (1)

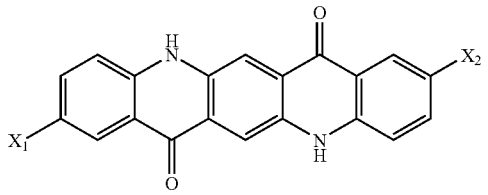

In the formula (1), $X_1$ and $X_2$ each independently represent a hydrogen atom, a halogen atom, an alkyl group or an alkoxy group.

Of these pigment compositions, C.I. Pigment Red 122, C.I. Pigment Red 202 and C.I. Pigment Violet 19, each of which is named in Color Index 4th Edition, are suitably employed in view of their hue, light fastness and the like.

Examples of the monoazo colorant for use in the invention include pigment compositions represented by following formula (2).

Formula (2)

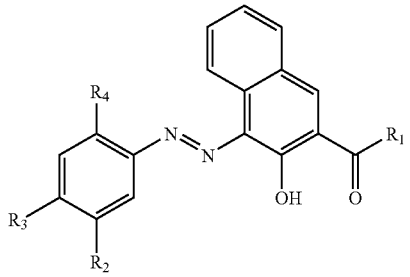

In the formula (2), $R_1$, $R_2$ and $R_3$ each independently represent a hydrogen atom, a halogen atom, an alkyl group, an alkoxy group, a nitro group, an amido group, a sulfonyl group or a sulfamoyl group. $R_4$ represents a group selected from the following groups:

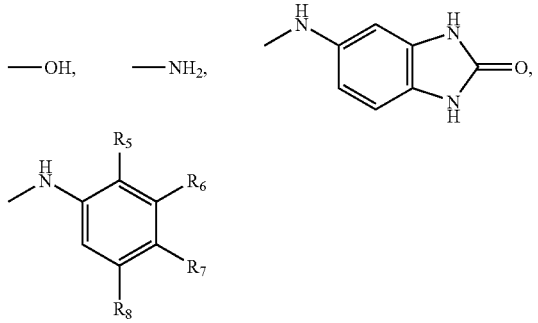

wherein $R_5$, $R_6$, $R_7$ and $R_8$ each independently represent a hydrogen atom, a halogen atom, an alkyl group or a nitro group.

Of these pigment compositions, C.I. Pigment Red 5, C.I. Pigment Red 31, C.I. Pigment Red 146, C.I. Pigment Red 150, C.I. Pigment Red 176, C.I. Pigment Red 185 and C.I. Pigment Red 238, each of which is named in Color Index 4th Edition, are suitably employed in view of their hue, light fastness and the like.

The mixed crystal of two or more colorants can be produced by known methods. For example, it can be obtained by a method described in U.S. Pat. No. 3,140,510 in which method mixed crystal components are recrystallized together from sulfuric acid or a solvent similar thereto, or by a solvent treatment following the recrystallization. The mixing ratio of the two or more colorants may be determined appropriately according to the desired color. Depending on the combination of pigments, the pigments can be employed at a mixing weight ratio within the range from 1:99 to 99:1. A quinacridone colorant and a monoazo colorant can form a mixed crystal at any ratio.

Method for the Production of Toner for Developing Electrostatic Images

The toner of the invention is preferably produced by a method comprising preparing an aggregated particle dispersion by mixing a resin particle dispersion obtained by dispersing resin particles and a colorant dispersion obtained by dispersing a colorant in an aqueous medium, and making the resin particles and the colorant aggregate to form aggregated particles and forming the toner particles by heating and fusing the aggregated particles.

Furthermore, the presently invented method for producing a toner for developing electrostatic images preferably includes a first, second and third steps as follows.

First Step

The first step is preparing an aggregated particle dispersion by heating a dispersion containing at least resin particles dispersed in dispersion medium to a temperature not higher than the glass transition point of the resin particles to form aggregated particles. Hereinafter, the first step is sometimes called "aggregation step".

At first, resin particles are dispersed to yield a dispersion. Examples of the resin of the resin particles include thermoplastic binder resin. Specific examples thereof include homopolymers and copolymers of styrenes such as styrene, parachlorostyrene and α-methylstyrene (styrenic resin); homopolymers and copolymers of esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate (vinyl resin); homopolymers and copolymers of vinylnitriles such as acrylonitrile and methacrylonitrile (vinyl resin); homopolymers and copolymers of vinyl ethers such as vinyl methyl ether and vinyl isobutyl ether (vinyl resin); homopolymers and copolymers of vinyl ketones such as vinyl methyl ketone, vinyl ethyl ketone and vinyl isopropenyl ketone (vinyl resin); homopolymers and copolymers of olefins such as ethylene, propylene, butadiene and isoprene (olefinic resin); non-vinyl condensed resin such as epoxy resin, polyester resin, polyurethane resin, polyamide resin, cellulosic resin and polyether resin; and graft polymers resulting from these non-vinyl condensed resins and vinylic monomers. These resins may be employed either alone or in combination.

Of these resins, styrenic resin, vinyl resin, polyester resin and olefinic resin are preferable. Copolymers of styrene and n-butyl acrylate, copolymers of bisphenol A and fumaric acid, and copolymers of styrene and olefin are particularly preferable.

Generally the average particle diameter of the resin particles is preferably not more than 1 μm and, in particular, preferably ranges 0.01 to 0.5 μm. If the average particle diameter exceeds 1 μm, the particle size distribution of a resulting toner for developing electrostatic images will become broad or free particles will be formed. Thus, the performance and reliability of the toner are likely to be affected. On the other hand, average particle diameters of 1 μm or less are advantageous because the above-mentioned drawbacks are eliminated. Moreover, when the average particle diameter is 1 μm or less, uneven distribution of the resin particles among toners is reduced and a good dispersion of the resin particles in the toners is achieved. Thus, variations of performance and reliability are advantageously reduced. The average particle diameter of the resin particles can be measured, for example, by use of a Coulter counter.

Generally the average particle diameter of the mixed crystal colorant is preferably not greater than 1 μm, more preferably 0.01 to 1 μm and particularly preferably 0.01 to 0.5 μm. If the average particle diameter exceeds 1 μm, the particle size distribution of a resulting toner for developing electrostatic images will become broad or free particles will be formed. Thus, the performance and reliability of the toner are likely to be affected. On the other hand, average particle diameters of 1 μm or less are advantageous because the above-mentioned drawbacks are eliminated. Moreover, when the average particle diameter is 1 μm or less, uneven distribution of the mixed crystal colorant among toners is reduced and a good dispersion of the mixed crystal colorant in the toners is achieved. Thus, variations of performance and reliability are advantageously reduced. This average particle diameter can also be measured, for example, by use of a Coulter counter.

The dispersion of the resin particles may contain the colorant. The combination thereof is not particularly restricted and may be chosen appropriately and freely depending on purposes.

In the invention, depending on purposes, the dispersion may contain additional ingredients dispersed therein such as a releasing agent, an internal additive, a charge-controlling agent, inorganic particles, a lubricant and an abrasive. In such an occasion, particles of the additional ingredients may be dispersed in a dispersion containing resin particles dispersed. Alternatively, a dispersion containing particles of the additional ingredients dispersed may be mixed with a dispersion containing resin particles dispersed.

Examples of the releasing agent used herein include low molecular weight polyolefins such as polyethylene, polypropylene and polybutene; silicones having softening points at which they are softened when being heated; fatty acid amides such as oleic acid amide, erucic acid amide, ricinoleic acid amide and stearic acid amide; vegetable waxes such as Carnuba wax, rice wax, candelilla wax, Japan wax and jojoba oil; animal waxes such as beeswax; mineral/oil waxes such as montan wax, ozocerite, ceresin, paraffin wax, microcrystalline wax and Fischer Tropsch wax; and their modified products.

These waxes easily form fine particles not greater than 1 μm when they are dispersed in water together with an ionic surfactant, a high polymer electrolyte such as a high polymer acid and a high polymer base, are heated to melting points of the waxes, and are treated with a homogenizer or pressure discharge disperser which can apply a strong shearing force.

Examples of the internal additive include magnetic materials, e.g. metals such as ferrite, magnetite, reduced iron, cobalt, nickel and manganese, alloys or compounds containing those metals.

Examples of the charge-controlling agent include dyes made of quaternary ammonium salt compounds, nigrosine compounds or complexes of aluminum, iron, chromium or the like and triphenylmethane pigments. From the viewpoints of control of ionic strength which influences the stability at the time of aggregation or fusion and reduction in waste water contamination, charge-controlling agents made of materials less soluble in water are desirable as the charge-controlling agent for use in the invention.

Examples of the inorganic particles include any particles conventionally used as external additives to the surface of toner, e.g. silica, alumina, titania, calcium carbonate, magnesium carbonate, calcium phosphate and cerium oxide.

Examples of the lubricant include fatty acid amides such as ethylene bisstearamide and oleic acid amide, and fatty acid metal salts such as zinc stearate and calcium stearate.

Examples of the abrasive include silica, alumina, cerium oxide and the like, which are mentioned previously.

Generally the average diameters of the additional ingredients mentioned above are preferably not greater than 1 μm and, in particular, preferably 0.01 to 0.5 μm. If the average particle diameter exceeds 1 μm, the particle size distribution of a resulting toner for developing electrostatic images will become broad or free particles will be formed. Thus, the performance and reliability of the toner are likely to be affected. On the other hand, average particle diameters of 1 μm or less are advantageous because the above-mentioned drawbacks are eliminated. Moreover, when the average particle diameter is 1 μm or less, uneven distributions of the additional ingredients among toners are reduced and good dispersions of the additional ingredients in the toners are achieved. Thus, variations of performance and reliability are advantageously reduced. The average particle diameter referred to here can also be measured, for example, by use of a Coulter counter.

Examples of the dispersion medium in the dispersion of the resin particles include aqueous mediums. Examples of the aqueous mediums include water, such as distilled water and ion-exchange water, and alcohols. These may be employed either alone or in combination. In the invention, it is desirable to add and mix a surfactant to the aqueous mediums. Examples of the surfactant to be used include anionic surfactants such as those of sulfuric ester salt type, sulfonic acid salt type, phosphoric acid ester type and soap type; cationic surfactants such as those of amine salt type and quaternary ammonium salt type; nonionic surfactants such as those of polyethylene glycol type, alkylphenol ethylene oxide adduct type and polyhydric alcohol type. Of these surfactants, the anionic surfactants and the cationic surfactants are preferable. The nonionic surfactants are preferably employed together with the anionic surfactants or cationic surfactants. The surfactants may be employed alone or in combination. Specific examples of the anionic surfactants include sodium dodecylbenzenesulfonate, sodium dodecylsulfate, sodium alkylnaphthalenesulphonate and sodium dialkylsulfosuccinate. Specific examples of the canionic surfactants include alkylbenzenedimethylammonium chloride, alkyltrimethylammonium chloride and distearylammonium chloride. Of these surfactants, ionic surfactants such as anionic surfactants and cationic surfactants are preferable.

The content of the resin particles in the dispersion is only required to be not more than 40% by weight and is preferably appropriately 2 to 20% by weight in an aggregated particle dispersion at the time when the aggregated particles are formed. When the colorants or magnetic materials previously mentioned are also dispersed in the dispersion, the content of the colorants in the dispersion is only required to be not more than 50% by weight and is preferably appropriately 2 to 40% by weight in an aggregated particle dispersion at the time when the aggregated particles are formed.

When the additional ingredients are also dispersed in the dispersion, the content of the additional ingredients in the dispersion is only required to be an amount such that the effect of the invention is not affected. The content generally is a slight amount. It is desirably about 0.01 to 5% by weight, and, in particular, preferably about 0.5 to 2% by weight in the aggregated particle dispersion at the time when the aggregated particles are formed. When the content is out of these ranges, the effect caused by dispersing the additional ingredients may be insufficiently demonstrated or the particle size distribution may get broader to result in deterioration of characteristics.

The dispersion of resin particles is prepared, for example, in the following manner. When the resin in the resin particles is a homopolymer or copolymer of vinyl monomers such as esters having a vinyl group, vinyl nitrites, vinyl ethers and vinyl ketones (vinyl resin), a dispersion in which resin particles of the homopolymer or copolymer of the vinyl monomers (vinyl resin) are dispersed in ionic surfactant is prepared by polymerizing the vinyl monomers by emulsion polymerization, seed polymerization or the like in the ionic surfactant. When the resin in the resin particles is a resin made from monomers other than the vinyl monomers, if the resin can dissolve in an oily solvent having a relatively low solubility to water, a dispersion in which resin particles of the resin other than vinyl resins are dispersed in ionic surfactant is prepared by dissolving the resin in the oily solvent, then finely dispersing the resulting solution together with the ionic surfactant, a high polymer electrolyte and the like in water by means of a dispersing device such as a homogenizer, and thereafter heating or reducing the pressure to distill the oily solvent off.

The dispersing means is not particularly restricted. For example, dispersing devices known per se, such as a rotation shearing homogenizer and devices containing media such as a ball mill, a sand mill and a dyno-mill, can be used.

The aggregated particles are prepared, for example, in the following manner. To a first dispersion in which at least the resin particles are dispersed in an aqueous medium containing an ionic surfactant, (1) an ionic surfactant having a polarity opposite to that of the above-mentioned ionic surfactant, or (2) an aqueous medium containing the ionic surfactant (1), or (3) a second dispersion containing the aqueous medium is mixed. When the mixed liquid is stirred, the resin particles and the like are aggregated in the dispersion through the action of the ionic surfactants, so that aggregated particles made of the resin particles and the like are formed. Thus, the aggregated particle dispersion is prepared. The mixing is carried out at a temperature not higher than the glass transition point of the resin of the resin particles contained in the mixed liquid. When the mixing is carried out under such a temperature condition, the aggregation proceeds with stability. The second dispersion is a dispersion containing the resin particles, the aforementioned colorants and/or particles of additional ingredients dispersed therein. The stirring can be carried out by use of a stirring device known per se, such as a homogenizer and a mixer.

In the case of (1) or (2) mentioned above, aggregated particles resulting from aggregation of the resin particles dispersed in the first dispersion are formed. In this case, generally the content of the resin particles in the first dispersion is desirably 5 to 60% by weight and, in particular, is preferably 10 to 40% by weight. The content of the aggregated particles in the aggregated particle dispersion at the time when the aggregated particles are formed is generally 40% by weight or less.

In the case of (3) mentioned above, if the particles dispersed in the second dispersion are the resin particles previously mentioned, aggregated particles are formed which result from aggregation of the resin particles dispersed in the second dispersion and the resin particles dispersed in the first dispersion. On the other hand, if the particles dispersed in the second dispersion are colorants and/or particles of additional ingredients, aggregated particles are formed which result from hetero aggregation of these materials with the resin particles dispersed in the first dispersion. Moreover, if the particles dispersed in the second dispersion are resin particles, colorants and/or particles of additional ingredients, aggregated particles are formed which result from aggregation of these materials with the resin particles dispersed in the first dispersion. In this case, generally the content of the resin particles in the first dispersion is desirably 5 to 60% by weight and, in particular, is preferably 10 to 40% by weight. On the other hand, generally the content of the resin particles, colorants and/or the particles of additional ingredients in the second dispersion is desirably 5 to 60% by weight and, in particular, is preferably 10 to 40% by weight. When the contents are out of those ranges, the particle size distribution may get broader to result in deterioration of characteristics. Generally the content of the aggregated particles in the aggregated particle dispersion at the time when the aggregated particles are formed is desirably 40% by weight or less. When forming aggregated particles or adhered particle, it is desirable to make the ionic surfactant contained in the dispersion to which the other dispersion is added have a polarity opposite to that of the ionic surfactant contained in the dispersion to be added, thereby varying the balance between the polarities.

Although the average particle diameter of the aggregated particles formed is not particularly limited, it generally is controlled so as to be approximately equal to the average particle diameter of the desired toner for developing electrostatic images. This control can be done, for example, through appropriate setting and changing of the temperature and the stirring and mixing conditions.

When the first step described above is executed, aggregated particles having an average particle diameter approximately equal to that of the toner for developing electrostatic images are formed and an aggregated particle dispersion containing the aggregated particles dispersed therein is prepared. The aggregated particles are sometimes called "mother particles."

Second Step

The second step is further adding and mixing a fine particle dispersion containing fine particles (additional particles) dispersed therein to the aggregated particle dispersion obtained in the first step to make the fine particles adhere to the aggregated particles, thereby forming adhered particles. Hereinafter, the second step is sometimes called "adhesion step."

Examples of the fine particles (additional particles) further added in the second step include resin-containing fine particles, inorganic fine particles, colorant fine particles, releasing agent fine particles, internal additive fine particles, and charge-controlling agent fine particles.

The resin-containing fine particles used herein are particles containing at least one resin selected from the resins previously mentioned, that is, the resins mentioned in the description of the first step. The resin-containing fine particles may be either resin fine particles containing at least one resin selected from the resins mentioned above in an amount of 100% by weight or composite fine particles containing at least one resin selected from the resins mentioned above and at least one substance selected from the colorant, inorganic particles, releasing agent, internal additive and charge-controlling agent. In the invention, of the composite fine particles, composite (resin/colorant) fine particles containing at least one resin selected from the resins previously mentioned and at least one colorant selected from the colorants previously mentioned are desirable.

The inorganic fine particles are fine particles containing at least one kind of inorganic particles selected from the inorganic particles mentioned previously. The colorant fine particles used herein are fine particles containing at least one colorant selected from the colorants mentioned previously. The releasing agent fine particles are fine particles containing at least one releasing agent selected from the releasing agents mentioned previously. The internal additive fine particles are fine particles containing at least one internal additive selected from the internal additives mentioned previously. The charge-controlling agent fine particles are fine particles containing at least one charge-controlling agent selected from the charge-controlling agents mentioned previously.

Of these fine particles, resin-containing fine particles, inorganic fine particles, colorant fine particles or releasing agent fine particles are desirable. The resin-containing fine particles are suitably employed, for example, in the production of multicolor toners for developing electrostatic images. When the resin-containing fine particles are employed, a layer of the resin-containing fine particles is formed on the surface of the aggregated particles resulting from the aggregation of resin particles and colorant. Therefore, the use of the resin-containing fine particles can minimize the influence on the charging behavior caused by the colorant and can make it less prone to cause difference in charging characteristics depending on the kind of colorant. Choosing a resin having a high glass transition point can make it possible to produce a toner for developing electrostatic images with well-balanced hot preservative property and fixability.

Moreover, to use resin-containing fine particles (composite particles of resin and colorant) and adhere them to the aggregated particles makes it possible to produce a toner for developing electrostatic images with a more complicated hierarchical structure. To use inorganic fine particles and adhere them to the aggregated particles makes it possible to produce a toner for developing electrostatic images which is capsulated within a layer of the inorganic fine particles after the fusion in the third step.

Generally the average diameter of the fine particles further added in the second step is desirably not greater than 1 μm and, in particular, preferably 0.01 to 0.5 μm. If the average particle diameter exceeds 1 μm, the particle size distribution of a resulting toner for developing electrostatic images will become broad or free particles will be formed. Thus, the performance and reliability of the toner are likely to be affected. On the other hand, average particle diameters of 1 μm or less are advantageous because the above-mentioned drawbacks are eliminated and a layer structure of the fine particles is formed. The average particle diameter can be measured, for example, by use of a Coulter counter.

The volume of the fine particles depends on a volume fraction of the resulting toner for developing electrostatic images and is preferably up to 50% of the volume of the resulting toner for developing electrostatic images. If the volume of the fine particles exceeds 50% of that of the resulting toner for developing electrostatic images, the fine particles do not adhere or aggregate to the aggregated particles. This will adversely result in the formation of new aggregated particles made of the fine particles. This also will cause noticeable variation in composition distribution or particle size distribution of the resulting toner for developing electrostatic images and a desired performance may not be obtained.

In the fine particle dispersion, only one kind of fine particles may be dispersed or, alternatively, two or more kinds of fine particles may be used together. In the latter case, any combination of fine particles used together is available with no particular limitations and may be chosen appropriately depending on purposes.

Examples of the dispersion medium in the fine particle dispersion include aqueous mediums such as those previously mentioned. In the invention, it is preferable to add and mix at least one surfactant selected from those previously mentioned to the aqueous medium.

Generally the content of the fine particles in the fine particle dispersion is desirably 5 to 60% by weight and, in particular, is preferably 10 to 40% by weight. If the content is out of these ranges, the structure and composition of the toner for developing electrostatic images from its inside through its surface will sometimes be controlled insufficiently. In addition, generally the content of the aggregated particles in the aggregated particle dispersion at the time when the aggregated particles are formed is desirably 40% by weight or less.

The fine particle dispersion is prepared, for example, by dispersing fine particles in aqueous medium containing an ionic surfactant or the like. The fine particle dispersion containing composite fine particles dispersed therein is prepared by dissolving at least one resin selected from those previously mentioned and at least one pigment selected from those previously mentioned in solvent, then finely dispersing the resulting solution together with ionic surfactant, high polymer electrolyte and the like in water by means of a dispersing device such as a homogenizer, and thereafter heating or reducing the pressure to distill and remove the solvent. It may also be prepared by adsorbing and fixing the resin and pigment, electrically or by mechanically shearing action, to the surface of latex prepared by emulsion polymerization or seed polymerization.

In the second step, adhered particles are formed by adding and mixing the fine particle dispersion to the aggregated particle dispersion prepared in the first step, thereby adhering the fine particles to the aggregated particles. The fine particles are sometimes called "additional particles" because they are particles which are added newly to the aggregated particles.

The method for the addition and mixing used herein is not particularly limited. For example, it may be conducted continuously or alternatively may be conducted stepwise in two or more separate steps. When fine particles (additional particles) are added and mixed in such manners, it is possible to control the generation of minute particles to sharpen the particle size distribution of the resulting toner for developing electrostatic images. When the addition and mixing is conducted stepwise in two or more separate steps, a layer of the fine particles is formed stepwise on the surface of the aggregated particles. This will allow the particles of a toner for developing electrostatic images to have structural variation or compositional gradient from their inside through their surface, resulting in improvement in surface hardness of the particles. In addition, it is also possible to maintain the particle size distribution to control the variation thereof during the fusion in the third step. Moreover, it is possible to eliminate the necessity of adding surfactants or stabilizers such as a base or an acid for enhancing the stability during the fusion. It is also possible to keep the amounts of these substances added at minimum. Thus, such stepwise addition and mixing is advantageous because it can reduce cost and improve the quality of products.

The conditions under which fine particles are made adhere to aggregated particles are as follows. The temperature is not higher than the glass transition point of the resin of the resin particles in the first step and is preferably about room temperature. Heating at a temperature not higher than the glass transition point makes the aggregated particles and the fine particles easy to adhere to each other and, as a result, makes the resulting adhered particles easy to become stabile. The treatment time cannot be regulated uniformly because it depends on the temperature mentioned above. However, generally it is approximately from 5 minutes to 2 hours. The dispersion containing the aggregated particles and the fine particles may either be left stand or be stirred slowly with a mixer or the like during the adhesion. The latter is more advantageous because uniform adhered particles are formed more easily.

In the invention, the second step may be conducted either only once or two or more times. In the case where that step is conducted only once, the fine particles (additional particles) will form only one layer on the surface of the aggregated particles. On the other hand, when the step is repeated two or more times, the fine particles (additional particles) will form two or more layers, layer by layer, on the surface of the aggregated particles. The latter case is more advantageous because a toner for developing electrostatic images which has a complicated and precise hierarchical structure can be obtained and also because desired functions can be imparted to the toner for developing electrostatic images.

When the second step is repeated two or more times, any combination of the fine particles which are made adhere to the aggregated particles first and those which are made adhere after the first adhesion of fine particles is available and may be chosen appropriately depending on applications, purposes and the like of the toner for developing electrostatic images. For example, a combination such that releasing agent fine particles and resin-containing fine particles are made adhere in this order to aggregated particles, a combination such that colorant fine particles and resin-containing fine particles are made adhere in this order to aggregated particles, a combination such that resin-containing fine particles and inorganic fine particles are made adhere in this order to aggregated particles and a combination such that releasing agent fine particles and colorant fine particles are made adhere in this order to aggregated particles are desirable.

In the case of the combination such that releasing agent fine particles and resin-containing fine particles are made adhere in this order, the releasing agent fine particles are not exposed in the surface of particles of a toner for developing electrostatic images and are present near the surface of the particles because a layer of the resin-containing fine particles exists on the outermost surface of the particles of the toner for developing electrostatic images. It, therefore, is possible to make the releasing agent fine particles act effectively at the time of fixation while inhibiting the exposure of the releasing agent fine particles. In the case of the combination such that colorant fine particles and resin-containing fine particles are made adhere in this order, the colorant fine particles are not exposed in the surface of particles of a toner for developing electrostatic images and are present near the surface of the particles because a layer of the resin-containing fine particles exists on the outermost surface of the particles of the toner for developing electrostatic images. Detachment of the colorant fine particles from the surface of the particles is therefore prevented.

In the case of the combination such that resin-containing fine particles and inorganic fine particles are made adhere in this order, a toner for developing electrostatic images which has a structure where the particles are encapsulated within the layer of the inorganic fine particles is obtained. When a combination such that a releasing agent particle dispersion and hard resin-containing fine particles or inorganic fine particles are made adhere in this order is adopted in place of the combinations described above, a hard shell can be formed on the outermost surface of a toner for developing electrostatic images.

When the second step is repeated two or more times, an embodiment where a dispersion containing fine particles and aggregated particles is heated at a temperature not higher than the glass transition point of the resin of the resin particles in the first step at every time when the fine particles are added and mixed. An embodiment where the temperature of the heating is increased stepwise is more desirable. Such embodiments are advantageous because the generation of free particles is inhibited.

Adhered particles resulting from the adhesion of fine particles to the aggregated particles prepared in the first step are formed through the second step described above. When the second step is repeated two or more times, adhered particles are formed which result from the two or more time adhesions of fine particles to the aggregated particles prepared in the first step. Thus, it is possible to design freely and produce a toner for developing electrostatic images which has desired characteristics by adhering properly chosen fine particles to the aggregated particles in the second step.

Third Step

The third step is heating the adhered particles to fuse. Hereinafter, the third step is sometimes called "fusing step."

The temperature at which the adhered particles are heated is required only to be a temperature from the glass transition temperature of the resin contained in the adhered particles to a temperature higher than the glass transition temperature by 100° C. Although the heating temperature varies depending on the kind of the resin of the resin particles and cannot be regulated uniformly, the temperature is preferably within the range from the glass transition temperature of the resin contained in the adhered particles to a temperature higher than the glass transition temperature by 50° C. The heating can be carried out by use of heating apparatus or device known per se. The time for fusion may be short if the heating temperature is high enough. However, a long time is required if the heating temperature is low. Although the time for fusion varies depending on the heating temperature and cannot be regulated uniformly, it is preferably from 30 minutes to 10 hours. In the invention, the toner for developing electrostatic images resulting after the completion of the third step may be washed and dried under appropriate conditions. Inorganic powders such as silica, alumina, titania and calcium carbonate, or particles of resin such as vinyl resin, polyester resin and silicone resin may be added to the surface of the resulting toner for developing electrostatic images by application of shearing force in a dry state. These inorganic particles and resin particles function as external additives such as fluidity aid and cleaning aid.

In the third step described above, the adhered particles prepared in the second step are fused together in the state where the fine particles (additional particles) are kept adhered to the surface of the aggregated particles (mother particles), thereby yielding a toner for developing electrostatic images. Toner for developing electrostatic images The presently invented toner for developing electrostatic images is preferably one produced by the presently invented method for the production of a toner for developing electrostatic images. The toner for developing electrostatic images is preferably one having a structure where aggregated particles form core particles and the surface of the particles is covered with a layer of fine particles. The toner may have either one layer or two layers of the fine particles. The number of the fine particle layer or layers is equal to the number of the second step conducted in the presently invented method for the production of a toner for developing electrostatic images.

The toner for developing electrostatic images produced in such a way has a structure where the composition, physical properties and the like vary continuously or uncontinuously from its inside to its surface and the variations thereof are controlled within desired ranges. The toner is therefore superior in various characteristics such as developability, transferability, fixability and cleanability. In addition, the toner is very reliable because it is able to demonstrate and keep these performances with stability. Furthermore, unlike toners produced by the kneading and pulverizing process or the like, the toner produced by the presently invented method for producing a toner for developing electrostatic images has a small average particle diameter and a sharp particle size distribution.

The volume average particle diameter of toner is preferably 2 to 9 μm, and more preferably 3 to 8 μm. Average particle diameters of less than 2 μm will easily result in insufficient electrostatic properties and, therefore, may lead to reduction in developability. If the average particle diameter exceeds 9 μm, the resolution of images may deteriorate. As a simplified indicator of the particle size distribution of toner, the volume average particle size distribution $GSD_v$ ($GSD_v$=(volume D84/volume D16)$^{0.5}$) or the number GSD (number GSD=(D84/D16)$^{0.5}$) using therein cumulative distributions D16 and D84 can be used. The $GSD_v$ is preferably not more than 1.30 and more preferably not more than 1.27. If the $GSD_v$ is more than 1.30, the developability may be deteriorated with time due to selective development or the like.

Electrostatic Image Developer

The electrostatic image developer of the invention contains the presently invented toner for developing electrostatic images described above and a carrier. The carrier is not particularly limited and may be a carrier known per se. For example, bearing bodies described in JP-A Nos. 62-39879, 56-11461 and the like can be employed. The mixing ratio of the presently invented toner for developing electrostatic images and the carrier in the electrostatic image developer is not particularly limited and may be chosen appropriately depending on the purpose.

Image-forming Method

An image-forming method of the invention includes electrostatic latent image-forming, toner image-forming and transferring. Each of the steps mentioned above is a conventional step per se and is described, for example, in JP-A Nos. 56-40868 and 49-91231. The image-forming method of the invention can be carried out by use of an image-forming apparatus such as copiers, printers and facsimile machines known per se.

The electrostatic latent image-forming is forming an electrostatic latent image on an electrostatic latent image holding member. The toner image-forming is forming a toner image by developing the electrostatic latent image by means of a developer layer formed on a developer holding member. The developer layer is not particularly limited as long as the layer contains the electrostatic image developer of the invention. The transferring is transferring the toner image onto a transfer member.

In the image-forming method of the invention, an embodiment including cleaning and recycling is preferable. The cleaning recovers excess toner for developing electrostatic images when a toner image is formed. The recycling transfers the toner for developing electrostatic images recovered in the cleaning step to a developer layer. An image-forming method of the embodiment including cleaning and recycling can be carried out using an image-forming apparatus, such as a copying machine and a facsimile machine, of a toner recycle system type. In addition, it is also possible to apply the image-forming method of the invention for a recycle system of an embodiment in which cleaning is omitted and toner is recovered simultaneously with the development of images.

EXAMPLES

Examples of the present invention will be explained below. However, the invention is not restricted to the examples. In the following description, the glass transition points of the resins in resin particles and toner particles are measured under conditions including a temperature increase rate of 3° C./minute using a differential scanning calorimeter (trade name: DSC-50, manufactured by Shimadzu Corporation).

Example 1

First Step

Preparation of Colorant Dispersion (1)

| | |
|---|---|
| Magenta pigment (Mixed crystal pigment consisting of C.I. Pigment Red 122 and C.I. Pigment Red 150 in a weight ratio of 55:45/This mixed crystal pigment is obtained by dissolving the two pigments in sulfuric acid at room temperature and adding the pigment solution in sulfuric acid to 10° C. water of an amount eight times that of the solution to perform hydrolysis.) | 50 parts by mass |
| Nonionic surfactant (trade name: Nonipol 400, manufactured by Sanyo Chemical Industries, Ltd.) | 5 parts by mass |
| Ion-exchange water | 200 parts by mass |

The materials listed above are mixed, dissolved and dispersed by means of a high-pressure impact dispersing apparatus Ulthimaizer (trade name: HJP30006, manufactured by Sugino Machine Ltd.) for about 1 hour. Thus, colorant dispersion (3) containing a colorant dispersed therein is prepared. The average particle diameter of the colorant in colorant dispersion (3) is 125 nm.

Preparation of Dispersion (1)

| | |
|---|---|
| Styrene | 370 parts by mass |
| n-Butyl acrylate | 30 parts by mass |
| Acrylic acid | 8 parts by mass |
| Dodecanthiol | 24 parts by mass |
| Carbon tetrabromide | 4 parts by mass |

In a flask, a mixture obtained by mixing and dissolution of the materials listed above is dispersed and emulsified in a mixture obtained by dissolution of 6 parts by mass of a nonionic surfactant (trade name: Nonipol 400, manufactured by Sanyo Chemical Industries, Ltd.) and 10 parts by mass of an anionic surfactant (trade name: Neogen SC, manufactured by Dai-ichi Kogyo Seiyaku Co., Ltd.) in 550 parts by mass of ion-exchange water. While the resulting emulsion is mixed slowly for 10 minutes, 50 parts by mass of ion-exchange water containing 4 parts by mass of ammonium persulfate is charged thereto. After purge with nitrogen, heating is conducted on an oil bath under the stirring inside the flask until the temperature of the content in the flask becomes 70° C. Emulsion polymerization is continued under those conditions for 5 hours. As a result, dispersion (1) in which resin particles having an average particle size diameter of 155 nm, a glass transition point of 59° C. and a weight average molecular weight (Mw) of 12,000 is prepared.

Preparation of Dispersion (2)

| | |
|---|---|
| Styrene | 280 parts by mass |
| n-Butyl acrylate | 120 parts by mass |
| Acrylic acid | 8 parts by mass |

In a flask, a mixture resulting from mixing and dissolution of the materials listed above is dispersed and emulsified in a mixture resulting from dissolution of 6 parts by mass of a nonionic surfactant (trade name: Nonipol 400, manufactured by Sanyo Chemical Industries, Ltd.) and 12 parts by mass of an anionic surfactant (trade name: Neogen SC, manufactured by Dai-ichi Kogyo Seiyaku Co., Ltd.) in 550 parts by mass of ion-exchange water. While the resulting emulsion is mixed slowly for 10 minutes, 50 parts by mass of ion-exchange water containing 3 parts by mass of ammonium persulfate is charged thereto. After purge with nitrogen, heating is conducted on an oil bath under the stirring inside the flask until the temperature of the content in the flask becomes 70° C. Emulsion polymerization is continued under that condition for 5 hours. Thus, dispersion (2) in which resin particles having an average particle size diameter of 105 nm, a glass transition point of 53° C. and a weight average molecular weight (Mw) of 550,000 is prepared.

Preparation of Aggregated Particles

| | |
|---|---|
| Dispersion (1) | 120 parts by mass |
| Dispersion (2) | 80 parts by mass |
| Colorant dispersion (1) | 30 parts by mass |
| Cationic surfactant | 1.5 parts by mass |

(trade name: Sunisol B50, manufactured by Kao Corporation):

The materials listed above are mixed and dispersed in a stainless steel round flask by use of a homogenizer (trade name: Ultra Turrax T50, manufactured by IKA). After the dispersion, the mixture is heated to 48° C. while the inside of flask is stirred on an oil bath for heating. After the mixture is held at 48° C. for 30 minutes, it is observed through an optical microscope. That aggregated particles having an average particle diameter of about 5 μm (volume: 95 $cm^3$) are formed is confirmed through the observation.

Second Step

Preparation of Adhered Particle

To the resulting mixture, 60 parts by mass of dispersion (1) as the resin-containing fine particle dispersion is added slowly. The volume of the resin particles contained in the dispersion (1) is 25 $cm^3$. Then, the temperature of the oil bath for heating is increased to 50° C., and the mixture is held for one hour. When the mixture is observed through an optical microscope, it is confirmed that adhered particles having an average particle diameter of 5.7 μm are formed.

Third Step

To the resulting mixture, 3 parts by mass of anionic surfactant (trade name: Neogen SC, manufactured by Daiichi Kogyo Seiyaku Co., Ltd.) is then added. Thereafter the stainless steel flask is sealed up. The mixture is then heated to 105° C. and held for 3 hours while being stirred continuously with a magnetic force seal. After cooling, the reaction product is filtered, fully washed with ion-exchange water and dried to yield a toner for developing electrostatic images.

Production of Electrostatic Image Developer

The resulting toner for developing electrostatic images and a ferrite carrier having an average particle diameter of 50 μm obtained by coating ferrite with poly(methyl methacrylate) (manufactured by The Soken Chemical & Engineering Co., Ltd., weight average molecular weight: 95,000) are mixed. Thus, a two-component electrostatic image developer with a toner concentration of 8% by weight is prepared.

Image Formation

Using this electrostatic image developer, a solid patch fixed image is formed on art paper (trade name: OK Kanafuji N, manufactured by Oji Paper Co., Ltd.) by means of an image-forming apparatus (a modified model of A Color, manufactured by Fuji Xerox). When the color of the image is measured, L*, a* and b* are 47.3, 76.9 and −5.2, respectively, and the color difference from the magenta of Japan Color, ΔE , is 2.1. Thus, the color demonstrated has a hue almost the same as and a color gamut a little wider than the magenta of Japan Color.

When a solid patch fixed image is formed on an OHP sheet in a manner similar to the above, its haze value is measured to be 14%. Thus, a good transparency is demonstrated.

The modified model of A Color is an image-forming apparatus which includes a latent image support, charging means for charging the surface of the latent image support, latent image-forming means for forming a latent image on a charged surface of the latent image support, a developing device which contains therein a developer made of a toner and a carrier and which develops the latent image by a developer layer formed on the surface of a developer support to form a toner image on the surface of the latent image support, and transferring means for transferring the toner image onto a transfer member.

Example 2

Preparation of Colorant Dispersion (2)

| | |
|---|---|
| Magenta pigment (Mixed crystal pigment consisting of C.I. Pigment Red 122 and C.I. Pigment Red 269 with a weight ratio of 50:50/This mixed crystal pigment is obtained by dissolving the two pigments in sulfuric acid at room temperature and adding the pigment solution in sulfuric acid to 10° C. water of an amount eight times that of the solution to perform hydrolysis.) | 50 parts by mass |
| Nonionic surfactant (Trade name: Nonipol 400, manufactured by Sanyo Chemical Industries, Ltd.): | 5 parts by mass |
| Ion-exchange water | 200 parts by mass |

The materials listed above are mixed, dissolved and dispersed by means of a high-pressure impact dispersing apparatus Ulthimaizer (trade name: HJP30006, manufactured by Sugino Machine Ltd.) for about 1 hour. Thus, colorant dispersion (3) containing a colorant dispersed is prepared. The average particle diameter of the colorant in the colorant dispersion (3) is 155 nm.

In Example 1, colorant dispersion (2) is used for the preparation of aggregated particles. Toner particles are prepared in the same manner as Example 1 except using a different kind of colorant dispersion. A solid patch fixed image is then formed on art paper (trade name: OK Kanafuji N, manufactured by Oji Paper Co.) by means of an image-forming apparatus (a modified model of A Color, manufactured by Fuji Xerox). When the color of the image is measured, L*, a* and b* are 47.1, 77.0 and −4.9, respectively, and the color difference from the magenta of Japan Color, ΔE , is 2.0. Thus, the color demonstrated has a hue almost the same as and a color gamut a little wider than the magenta of Japan Color.

When a solid patch fixed image is formed on an OHP sheet in a manner similar to the above, its haze value is measured to be 12%. Thus, a very good transparency is demonstrated.

Comparative Example 1

Preparation of Colorant Dispersion (3)

| | |
|---|---|
| Magenta pigment (C.I. Pigment Red 150) | 50 parts by mass |
| Nonionic surfactant (Trade name: Nonipol 400, manufactured by Sanyo Chemical Industries, Ltd.): | 5 parts by mass |
| Ion-exchange water | 200 parts by mass |

The materials listed above are mixed, dissolved and dispersed by means of a high-pressure impact dispersing apparatus Ulthimaizer (trade name: HJP30006, manufactured by Sugino Machine Ltd.) for about 1 hour. Thus, colorant dispersion (3) containing a colorant dispersed is prepared. The average particle diameter of the colorant in the colorant dispersion (3) is 135 nm.

Preparation of Colorant Dispersion (4)

| | |
|---|---|
| Magenta pigment (C.I. Pigment Red 122) | 50 parts by mass |
| Nonionic surfactant (Trade name: Nonipol 400, manufactured by Sanyo Chemical Industries, Ltd.): | 5 parts by mass |
| Ion-exchange water | 200 parts by mass |

The materials listed above are mixed, dissolved and dispersed by means of a high-pressure impact dispersing apparatus Ulthimaizer (HJP30006, manufactured by Sugino Machine Ltd.) for about 1 hour. Thus, colorant dispersion (4) containing a colorant dispersed is prepared. The average particle diameter of the colorant in the colorant dispersion (4) is 110 nm.

In Example 1, colorant dispersions (3) and (4) are used as the colorant dispersion used for the preparation of aggregated particles and the dispersions are each used in an amount of 15 parts by mass. Toner particles are prepared in the same manner as Example 1 except using a different kind of colorant dispersion in a different amount. A solid patch fixed image is then formed on art paper (trade name: OK Kanafuji N, manufactured by Oji Paper Co.) by means of an image-forming apparatus (a modified model of A Color, manufactured by Fuji Xerox). When the color of the image is measured, L*, a* and b* are 44.6, 75.2 and −4.1, respectively, and the color difference from the magenta of Japan Color, ΔE , is 2.0. As a result, the color demonstrated has a hue almost the same as and a color gamut a little narrower than the magenta of Japan Color.

When a solid patch fixed image is formed on an OHP sheet in a manner similar to the above, its haze value is measured to be 12%. Thus, a good transparency is demonstrated.

Comparative Example 2

In Example 1, only colorant dispersion (2) is used as the colorant dispersion used for the preparation of aggregated particles and the dispersion is used in an amount of 30 parts by mass. Toner particles are prepared in the same manner as Example 1 except using a different kind of colorant dispersion in a different amount. A solid patch fixed image is then formed on art paper (trade name: OK Kanafuji N, manufactured by oji Paper Co.) by means of an image-forming apparatus (a modified model of A Color, manufactured by Fuji Xerox). When the color of the image is measured, L*, a* and b* are 45.0, 79.2 and 5.4, respectively, and the color difference from the magenta of Japan Color, ΔE , is 10.7. It is visually clear that the color differs in hue from the magenta of Japan Color. The color demonstrates a color gamut a little more yellowish than the magenta of Japan Color.

When a solid patch fixed image is formed on an OHP sheet in a manner similar to the above, its haze value is measured to be 12%. Thus, a very good transparency is demonstrated.

Comparative Example 3

In Example 1, only colorant dispersion (4) is used as the colorant dispersion used for the preparation of aggregated particles and the dispersion is used in an amount of 30 parts by mass. Toner particles are prepared in the same manner as Example 1 except using a different kind of colorant dispersion in a different amount. A solid patch fixed image is then formed on art paper (trade name: OK Kanafuji N, manufactured by Oji Paper Co.) by means of an image-forming apparatus (a modified model of A Color, manufactured by Fuji Xerox). When the color of the image is measured, L*, a* and b* are 49.8, 73.2 and −18.6, respectively, and the color difference from the magenta of Japan Color, ΔE , is 14.7. Thus, the color is bluish in hue in comparison with the magenta of Japan Color and has a visually clear difference therefrom.

When a solid patch fixed image is formed on an OHP sheet in a manner similar to the above, its haze value is measured to be 11%. Thus, a good transparency is demonstrated.

Comparative Example 4

Preparation of Colorant Dispersion (5)

| | |
|---|---|
| Magenta pigment (C.I. Pigment Violet 19) | 50 parts by mass |
| Nonionic surfactant (Trade name: Nonipol 400, manufactured by Sanyo Chemical Industries. Ltd.): | 5 parts by mass |
| Ion-exchange water | 200 parts by mass |

The materials listed above are mixed, dissolved and dispersed by means of a high-pressure impact dispersing apparatus Ulthimaizer (trade name: HJP30006, manufactured by Sugino Machine Ltd.) for about 1 hour. Thus, colorant dispersion (4) containing a colorant dispersed is prepared. The average particle diameter of the colorant in the colorant dispersion (4) is 315 nm.

In Example 1, only colorant dispersion (5) is used as the colorant dispersion used for the preparation of aggregated particles and the dispersion is used in an amount of 30 parts by mass. Toner particles are prepared in the same manner as Example 1 except using a different kind of colorant dispersion in a different amount. A solid patch fixed image is then formed on art paper (trade name: OK Kanafuji N, manufactured by oji Paper Co.) by means of an image-forming apparatus (a modified model of A Color, manufactured by Fuji Xerox). When the color of the image is measured, L*, a* and b* are 50.2, 57.8 and 6.0, respectively, and the color difference from the magenta of Japan Color, ΔE , is 20.5. Thus, the color has a visually clear hue difference from the magenta of Japan Color.

When a solid patch fixed image is formed on an OHP sheet in a manner similar to the above, its haze value is measured to be 20%. Thus, the image does not have a sufficient transparency.

The invention provides a toner superior in coloring power without causing cloudiness. The present invention can provide a toner for developing electrostatic images which is superior in various properties such as chargeability, developability, transferability, fixability and cleanability, especially light transmissibility and coloring power and which satisfies a high image quality and a high reliability, and also provide an electrostatic image developer using the toner for developing electrostatic images. In addition, the invention can provide a toner for developing electrostatic images suitable for use in a two-component electrostatic image developer which exhibits a high transfer efficiency, requires a small consumption of toner, and has a long life can be provided. Moreover, the invention can provide a method for producing a toner for developing electrostatic images which method can produce a toner for developing electrostatic images superior in the properties mentioned above easily and simply without causing liberation of colorant, releasing agent and the like and also provide a colorant dispersion which is suitably employed in the production of a toner for developing electrostatic images and which contains the colorant with a good dispersability. In addition, the invention can provide an image-forming method by which a full color image of high saturation can be formed on paper and an OHP sheet easily and simply. Furthermore, the invention can provide an image-forming method which is highly suitable for systems reusing toners recovered from cleaners, namely, toner recycle systems and which can yield a high image quality superior in light transmitting property and coloring power in such systems.

What is claimed is:

1. A magenta toner for developing electrostatic images which comprises a binder resin and a colorant, wherein the colorant includes a mixed crystal of two or more colorants selected from quinacridone colorants and monoazo colorants, and when a solid patch is fixed on art paper complying with the ISO standard by using the toner, a resulting fixed image color satisfies at least one of the following formulae (A) and (B):

$$(b^*)<0.85(a^*)-67.92 \quad (A)$$

$$(b^*)>-7.94(a^*)+591.85 \quad (B), \text{ and}$$

wherein the color difference ΔE between the color of the fixed image and the color defined by L*: 46.6, a*: 75.1 and b*: −4.4 is less than 6.

2. A magenta toner according to claim 1, wherein the quinacridone colorant is a compound represented by the following formula (1):

Formula (1)

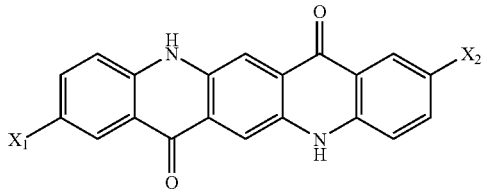

wherein $X_1$ and $X_2$ each independently represent a hydrogen atom, a halogen atom, an alkyl group or an alkoxy group.

3. A magenta toner according to claim 1, wherein the monoazo colorant is a compound represented by the following formula (2):

Formula (2)

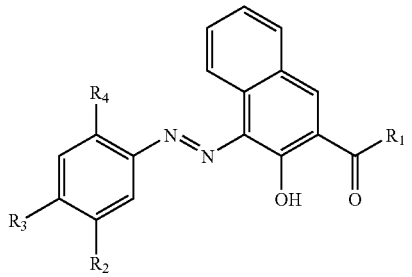

wherein $R_1$, $R_2$ and $R_3$ each independently represent a hydrogen atom, a halogen atom, an alkyl group, an alkoxy group, a nitro group, an amido group, a sulfonyl group or a sulfamoyl group; $R_4$ represents a group selected from the following groups:

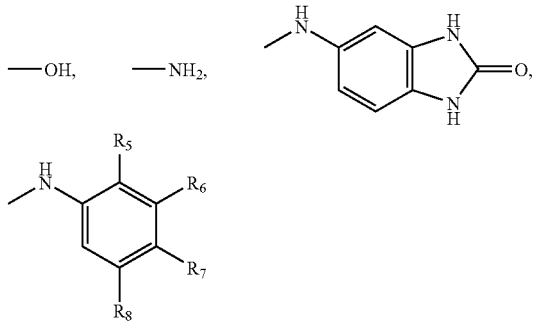

wherein $R_5$, $R_6$, $R_7$ and $R_8$ each independently represent a hydrogen atom, a halogen atom, an alkyl group or a nitro group.

4. A magenta toner according to claim 2, wherein the quinacridone colorant is selected from C.I. Pigment Red 122, C.I. Pigment Red 202, and C.I. Pigment Violet 19 as named in Color Index, 4th Edition.

5. A magenta toner according to claim 3, wherein the monoazo colorant is selected from the group consisting of C.I. Pigment Red 5, C.I. Pigment Red 31, C.I. Pigment Red 146, C.I. Pigment Red 150, C.I. Pigment Red 176, C.I. Pigment Red 185, and C.I. Pigment Red 238 as named in Color Index, 4th Edition.

6. A magenta toner according to claim 1, wherein the mixed crystal comprises two colorants in a mixing weight ratio ranging from 1:99 to 99:1.

7. A magenta toner according to claim 1, wherein the mixed crystal is obtained by dissolving the two or more colorants in sulfuric acid and then recrystallizing them together.

8. A magenta toner according to claim 1, wherein the magenta toner has a volume average particle diameter of 2 to 9 μm and a volume average particle size distribution $GSD_v$ of 1.30 or less.

9. A magenta toner according to claim 1, further comprising a releasing agent.

10. A method for producing a toner for developing electrostatic images, the method comprising:

a step of preparing an aggregated particle dispersion by mixing a resin particle dispersion obtained by dispersing resin particles and a colorant dispersion obtained by dispersing a colorant in an aqueous medium, and making the resin particles and the colorant aggregate to form aggregated particles; and a step of forming toner particles by heating and fusing the aggregated particles;

wherein the toner is a magenta toner in which the colorant includes a mixed crystal of two or more colorants selected from quinacridone colorants and monoazo colorants and when a solid patch is fixed on art paper complying with the ISO standard by using the toner, a resulting fixed image color satisfies at least one of the following formulae (A) and (B):

$$(b^*)<0.85(a^*)-67.92 \quad (A)$$

$$(b^*)>-7.94(a^*)+591.85 \quad (B), \text{ and}$$

wherein the color difference ΔE between the color of the fixed image and the color defined by L*: 46.6, a*: 75.1 and b*: −4.4 is less than 6.

11. A method according to claim 10, wherein the colorant dispersion is obtained by dispersing the colorant in the aqueous medium by means of an ultrasonic dispersing apparatus or a high-pressure impact dispersing apparatus.

12. An electrostatic image developer comprising a carrier and a magenta toner, wherein the magenta toner comprises a binder and a colorant, said colorant including a mixed crystal of two or more colorants selected from quinacridone colorants and monoazo colorants, and when a solid patch is fixed on art paper complying with the ISO standard by using the toner, a resulting fixed image color satisfies at least one of the following formulae (A) and (B):

$$(b^*)<0.85(a^*)-67.92 \quad (A)$$

$$(b^*)>-7.94(a^*)+591.85 \quad (B), \text{ and}$$

wherein the color difference ΔE between the color of the fixed image and the color defined by L*: 46.6, a*: 75.1 and b*: −4.4 is less than 6.

13. An electrostatic image developer according to claim 12, wherein the carrier has a resin coating layer.

14. An image-forming method, comprising:

a step of forming an electrostatic latent image on an electrostatic latent image holding member;

a step of developing the electrostatic latent image with a developer layer on a developer holding member layer to form a toner image;

a step of transferring the toner image onto a transfer member; and a step of cleaning to remove a toner for developing electrostatic images remaining on the electrostatic latent image holding member, wherein the developer contains a magenta toner including a colorant, which comprises a mixed crystal of two or more colorants selected from quinacridone colorants and monoazo colorants, and when a solid patch is fixed on art paper complying with the ISO standard by using the toner, a resulting fixed image color satisfies at least one of the following formulae (A) and (B):

$$(b^*)<0.85(a^*)-67.92 \quad (A)$$

$$(b^*)>-7.94(a^*)+591.85 \quad (B), \text{ and}$$

wherein the color difference ΔE between the color of the fixed image and the color defined by L*: 46.6, a*: 75.1 and b*: −4.4 is less than 6.

* * * * *